US005586915A

United States Patent [19]

Baker et al.

[11] Patent Number: 5,586,915

[45] Date of Patent: Dec. 24, 1996

[54] ELECTRICAL CONNECTOR WITH CONTACTS AT DIFFERENT INSERTION DEPTHS

[75] Inventors: Ronald J. Baker, York; Douglas G. Fisher, Boiling Springs; Martha L. Rupert, Hummelstown; David M. Swartz, York, all of Pa.

[73] Assignee: The Whitaker Corporation, Wilmington, Del.

[21] Appl. No.: 359,497

[22] Filed: Dec. 20, 1994

[51] Int. Cl.[6] ..... H01R 23/70

[52] U.S. Cl. ..... 439/733.1; 439/924.1

[58] Field of Search ..... 439/60, 660, 637, 439/733.1, 869, 924.1, 444

[56] References Cited

U.S. PATENT DOCUMENTS

| | | | |
|---|---|---|---|
| 3,193,791 | 7/1965 | Bock et al. | 439/637 |
| 3,701,082 | 10/1972 | Baumanis | 439/592 |
| 3,766,513 | 10/1973 | Carre | 439/660 |
| 3,818,280 | 6/1974 | Smith et al. | 439/633 |
| 4,084,875 | 4/1978 | Yamamoto | 439/274 |
| 4,200,349 | 4/1980 | Holland | 439/260 |
| 4,232,930 | 11/1980 | Teti | 439/680 |
| 4,343,523 | 8/1982 | Cairns et al. | 439/595 |
| 4,636,021 | 1/1987 | Bobb et al. | 439/260 |
| 4,842,538 | 6/1989 | Noschese | 439/260 |
| 4,990,108 | 2/1991 | Sakaguchi | 439/678 |
| 5,067,915 | 11/1991 | Kienast | 439/620 |
| 5,085,601 | 2/1992 | Buchter et al. | 439/660 |
| 5,174,787 | 12/1992 | Shirai et al. | 439/489 |
| 5,186,660 | 2/1993 | Wielgos et al. | 439/685 |
| 5,197,887 | 3/1993 | Davidge et al. | 439/60 |
| 5,236,372 | 8/1993 | Yunoki et al. | 439/260 |
| 5,273,461 | 12/1993 | Lee | 439/637 |

FOREIGN PATENT DOCUMENTS 2098079 10/1990 Japan .

*Primary Examiner*—Neil Abrams
*Attorney, Agent, or Firm*—Anton P. Ness

[57] ABSTRACT

An electric connector (1) comprises, an insulating housing (3), and contacts (7) in respective contact receiving cavities (8). The contacts (7) have respective marker surfaces (18) that align with respect to marker surfaces (21, 23) located in the staggered positions on the housing (3) to position at least one of the contacts (7) farther from a mating end (2) of the housing (3) than another of the contacts (7 ). The contacts (7) are to be inserted by engaging a straight surface of an insertion tool against their marker surfaces (18) and then impelling them along the cavities (8) until the marker surfaces (18) are aligned with respect to selected one or the other of the marker surfaces (21,23). The marker surfaces (21,23) can also serve to limit travel of the insertion tool. The contacts after such insertion are positioned in staggered rows and are retained by engagement of barbs (17) with walls of the cavities.

7 Claims, 6 Drawing Sheets

ELECTRICAL CONNECTOR WITH CONTACTS AT DIFFERENT INSERTION DEPTHS

FIELD OF THE INVENTION

The invention relates to an electrical connector comprising multiple electrical contacts that are staggered nearer and farther, respectively, from a mating end of the connector.

BACKGROUND OF THE INVENTION

Each of U.S. Pat. Nos. 3,193,791 and 3,818,280 and 4,200,349 and 4,343,523 and 4,636,021 and 4,842,538, discloses a concept of staggering contact surfaces on contact elements of a printed circuit board edge connector in the mating direction of the printed circuit board, thereby to reduce the force needed to mate the circuit board with the connector.

U.S. Pat. No. 5,085,601 discloses a connector comprising contacts with oppositely bowed contact surfaces to engage opposite sides of contact fins on another mating connector. The contact surfaces are nearer and farther, respectively, from a mating end of the connector to reduce insertion forces during mating with the contact fins.

U.S. Pat. No. 4,084,875 discloses signal and power contacts mixed in one electrical connector, with the signal contacts being spaced farther from a mating end of the connector than the power contacts, to mate with another mating connector after the power contacts have mated with the mating connector.

The connector is constructed with a combination of multiple contact receiving cavities having different spacings from a mating end of the connector. A housing manufactured with one combination of cavities having different spacings from a mating end, is not adaptable to changes in the combination to accommodate different contact spacings. Manufacture of a separate housing is required for each different combination of contact spacings.

The contacts are fabricated with different lengths prior to being assembled in respective cavities of an electrical connector. The contacts of different lengths provide a combination of staggered contacts at different distances from a mating end of the connector. Manufacturing costs are higher to produce contacts that differ from one another in size, as compared with the cost of manufacturing contacts that are identical.

SUMMARY OF THE INVENTION

According to an advantage of the invention, identical contacts in an electrical connector are installed in a common row with a changeable combination of contacts at different distances from a mating end of the connector.

According to another aspect of the invention, an electrical connector is adapted with electrical contacts, wherein at least one of the contacts is farther from a mating end of the housing to mate with another mating connector later than each other contact that is closer to the mating end. The contact that is spaced farther from the mating end will unmate from the mating connector before each closer contact unmates. The contact that is spaced farther from the mating end is identical in mass and in shape with the mass of a closer spaced contact.

According to an embodiment of the invention an insulating housing is constructed with identical contact receiving cavities, such that contacts of identical mass and shape can be interchanged in the cavities, and either one of the contact cavities can contain a contact that is further from a mating end of the housing than the contact in the other contact receiving cavity, and either one of the contact receiving cavities is adapted to receive identical contacts equally spaced from the mating end of the housing.

According to an embodiment of the invention, at least two marker surfaces are provided at different depths along an axis of the housing, and electrical contacts of identical shape are provided with respective marker surfaces that are aligned with respect to one of the marker surfaces on the housing depending upon the depth of insertion of the contacts along the housing.

DESCRIPTION OF THE DRAWINGS

An embodiment of the invention will now be described with reference to the drawings, according to which.

DESCRIPTION

Figure 2:
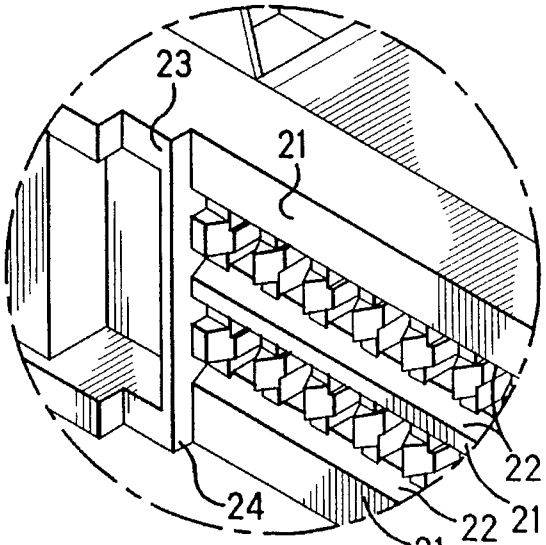
FIG. 2 is an isometric view of a portion of the housing as shown in FIG. 1.

With reference to FIGS. 1, 7, 8 and 10, an electrical connector 1 comprises a front or mating end 2 of the connector 1 on an insulating housing 3, a rear end 4 and a base 5 for mounting to a circuit board, not shown. A projecting alignment peg 6 extends beyond the base 5 to plug into an alignment aperture in a surface of the circuit board, not shown. The connector 1 further comprises, first electrical contacts 7 in respective contact receiving cavities 8 in a contact receiving front portion 9 of the housing 3.

Figure 5:
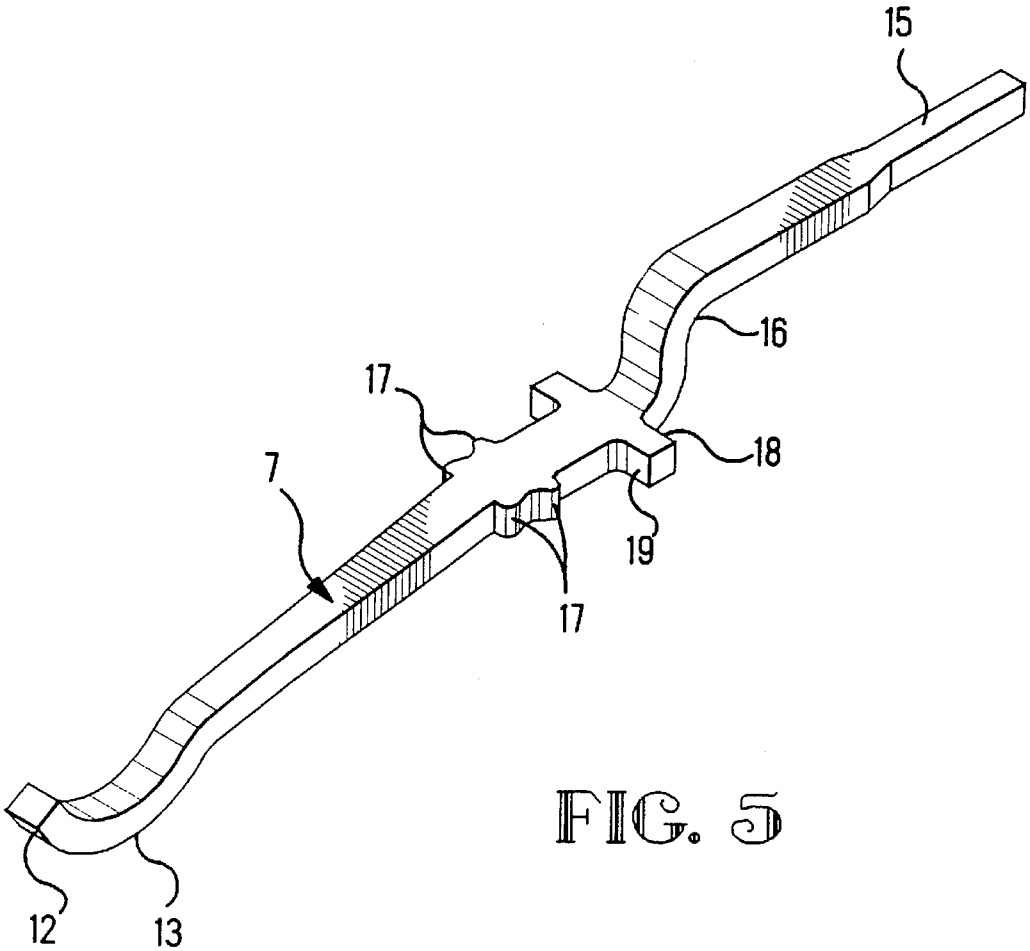
FIGS. 5 and 6 are isometric views of first and second electrical contacts of the connector shown in FIG. 1.
Figure 6:
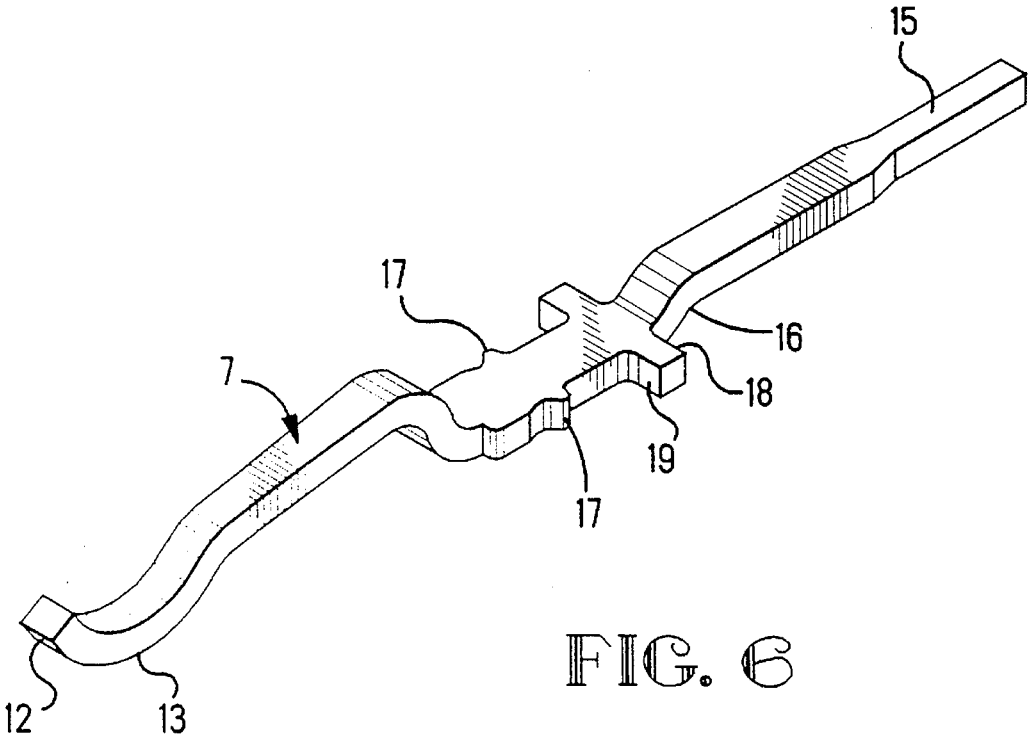
Figure 7:
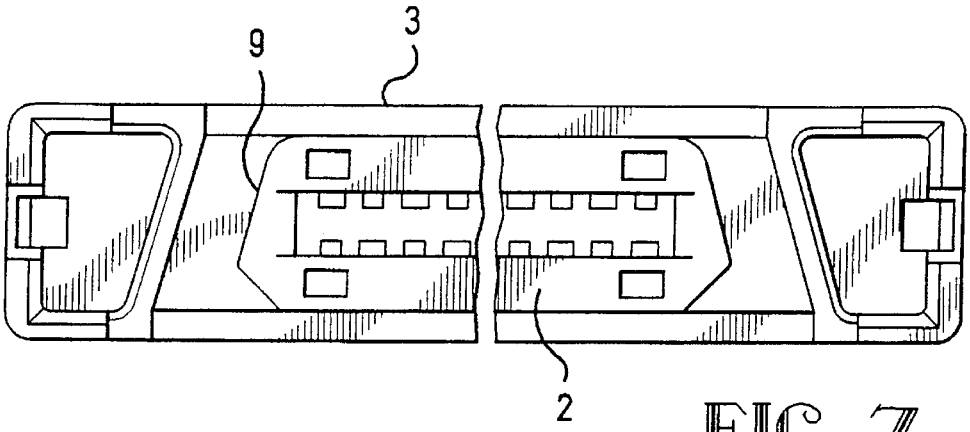
FIGS. 7 to 9 are fragmentary top, front and bottom views of an insulating housing of the connector shown in FIG. 1 to 4.
Figure 8:
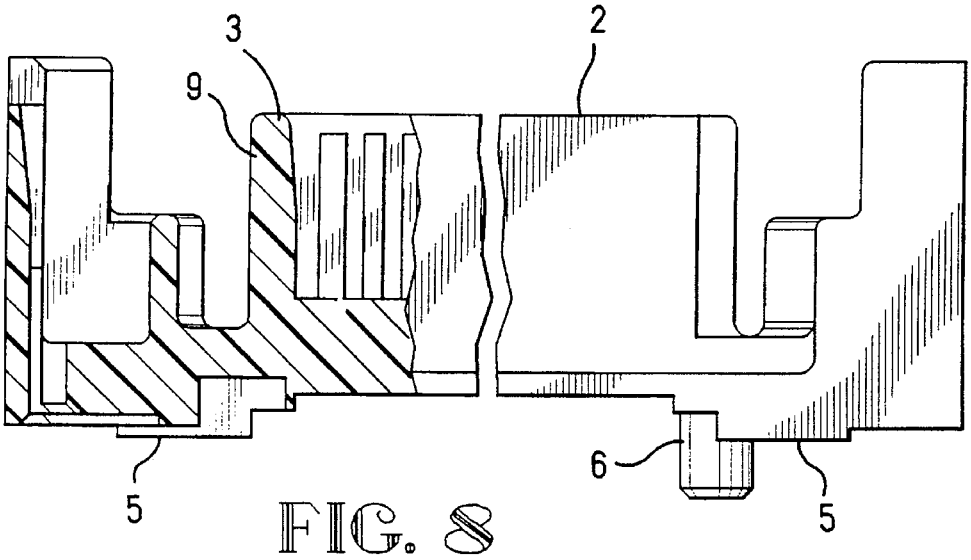
Figure 9:
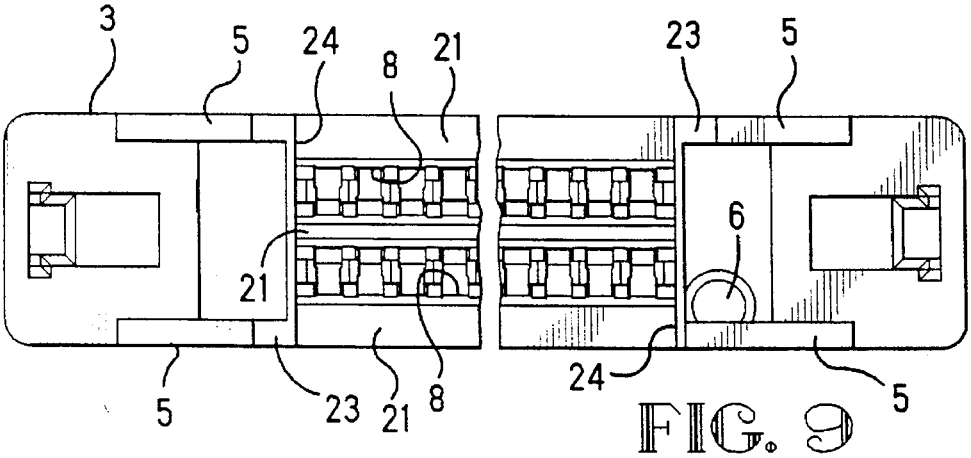

The contacts 7 and the cavities 8 are arranged in four rows 10, 11, of contacts 7 and cavities 8, in the housing 3. There are two exterior rows 10 of contacts 7, and two interior rows 11 of contacts 7. The contacts 7 along a common row of the contacts 7 are identical in size and shape and mass when manufactured. Thus, whether the connector 1 is constructed with one row of contacts 7, or whether the connector 1 is constructed with multiple rows of contacts 7, the contacts 7 in the same row are manufactured as being identical in size and shape and mass. The contact 7 shown in FIG. 5 is mounted in either one of the rows 10. The contact 7 shown in FIG. 6 is of different size and shape, as compared with the contact 7 shown in FIG. 5, and is adapted for mounting in either one of the rows 11. The contacts 7 in the same row are interchangeable in respective identical cavities 8 of the same row of cavities.

The contacts 7 are manufactured with a unitary, stamped and formed, metal construction. Front ends 12 on the contacts 7 are on identical mating contact portions 13 that project toward the mating end 2 along identical contact receiving front portions 14 of the cavities 8. Integral terminals 5 on the contacts 7 project outwardly of the rear end 4 of the housing 3 to plug into respective openings, not shown, through a circuit board on which the base 5 is mounted. The contacts 7 extend forwardly in a first direction toward the mating end 2. The contacts 7 project toward the rear end 4 of the housing 3, and are formed with a permanent, transverse bend 16 that extends the respective terminals 15 offset from the remainders of the corresponding contacts 7.

Figure 10:
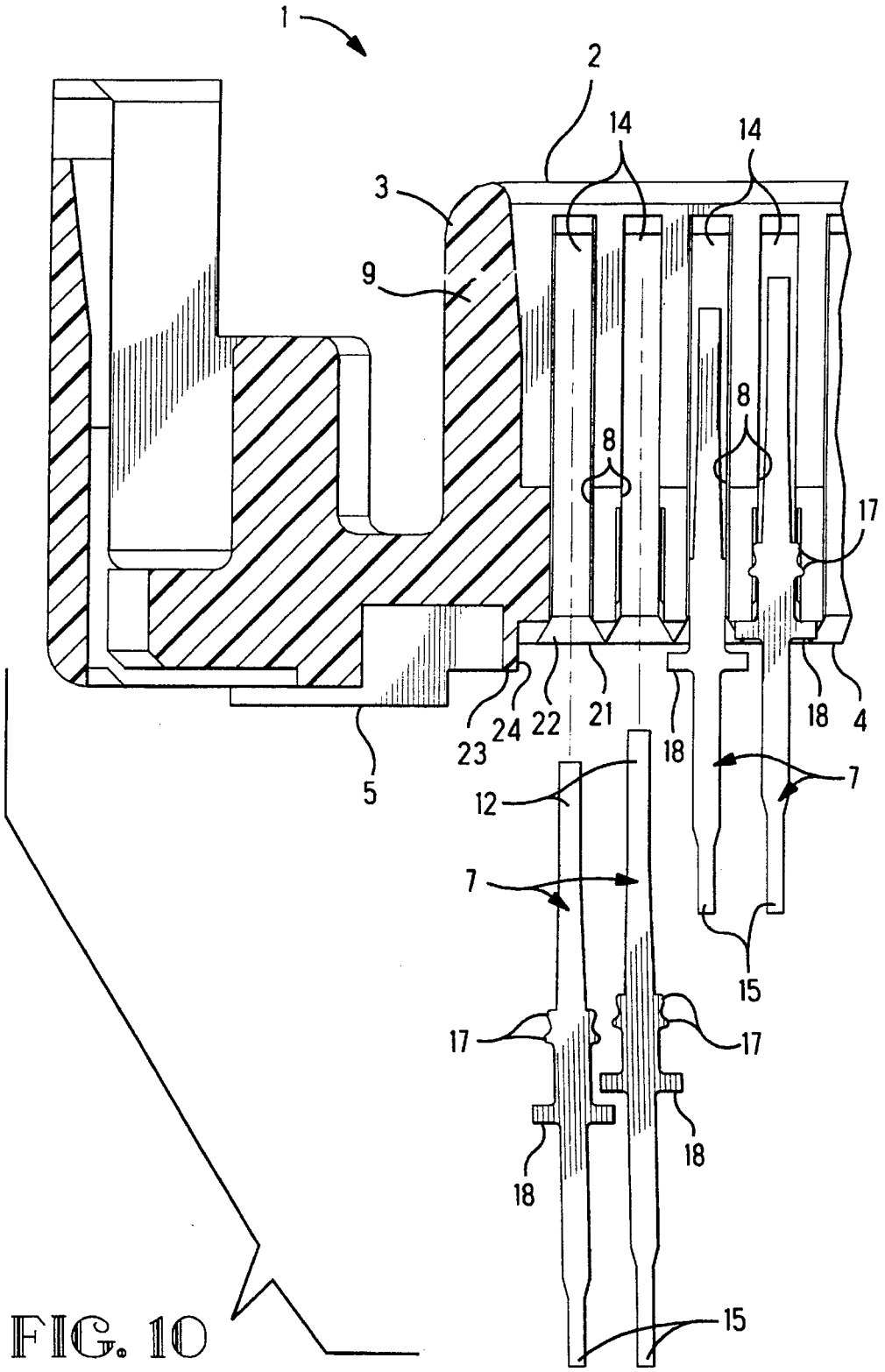
FIG. 10 is a fragmentary view of a portion of the connector shown in FIG. 1 with parts cut away and with parts separated from one another.
Figure 11:
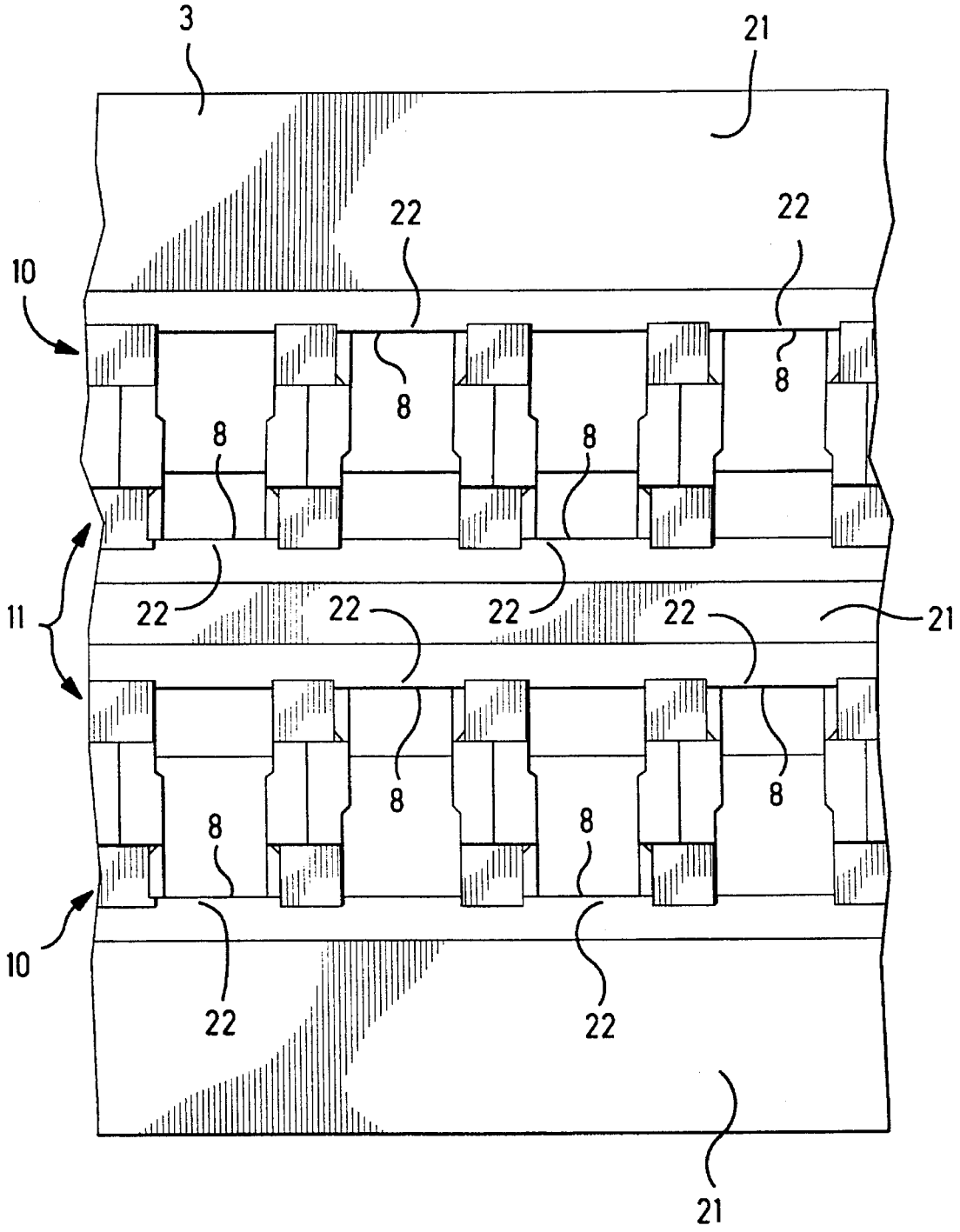
FIG. 11 is a fragmentary view of a portion of the housing as shown in FIG. 7.

As shown in FIGS. 5, 6 and 10, inclined barbs 17 along each of the contacts 7 are aligned along a thickness plane of the contacts 7. The barbs 17 impinge against an interior of a corresponding cavity 8. As the contact 7 is moved forwardly along the cavity 8 toward the mating end 2, the barbs 17 engage the interior of the cavity 8 to retain the contact 7 at its position inside the cavity 8. The barbs 17 provide a resistance force that resist further insertion of the contact 7, which resistance is overcome by a force applied to the contact 7 to move the contact 7 forward. If all of the contacts 7 remain identically spaced along the cavities 8, the front ends 12 of the contacts 7 will be equally spaced from the mating end 2 of the connector 1, and will be received equally spaced along the contact receiving front portion 9 of the housing 3.

With reference to FIG. 10, the barbs 17 on the contact 7 engage the interior of the cavity 8, and provide a resistance force that tends to resist further insertion of the contact 7 along the cavity 8. The contacts 7 in the same row remain identical in size, shape and mass as when manufactured. One of the contacts 7 is spaced farther from the mating end 2 of the housing 3 than at least one other contact 7 of identical mass. The contact 7 that is spaced farther from the mating end 2 is identical in shape with each said other contact 7 in the same row 10 or 11.

The contacts 7 in the connector 3 mate with mating contacts, not shown, of another mating electrical connector, not shown, to which the connector 3 is mated, for example, by plugging connection with the mating connector. The receded contact 7, farther from the mating end 2, provides a last to mate, first to unmate contact 7 when the connector is mated, and unmated, respectively, with another mating connector, not shown. Because the cavities 8 in the same row 10 or 11 are identical, and the contacts 7 where they extend along the cavities 8 are of identical construction, the contacts 7 can be interchanged in the cavities 8 in the same row.

With reference to FIGS. 3–6, each of the contacts 7 is provided with a marker surface 18 on a projecting flange 19. The flange 19 is aligned in a thickness plane of the contact 7. The flange 19 provides a tool rest against which an insertion tool, not shown, will engage to insert and move the corresponding contact 7 along a corresponding cavity 8. Each contact 7 is constructed for insertion and movement from rear to front along a corresponding cavity 8. When the contact 7 is inserted along a corresponding cavity 8, FIGS. 3 and 4, the flange 19 bridges across the corresponding cavity 8 and is received in a corresponding recess 20, FIG. 2, that bridges across the corresponding cavity 8 and faces rearward of the corresponding cavity 8.

Figure 1:
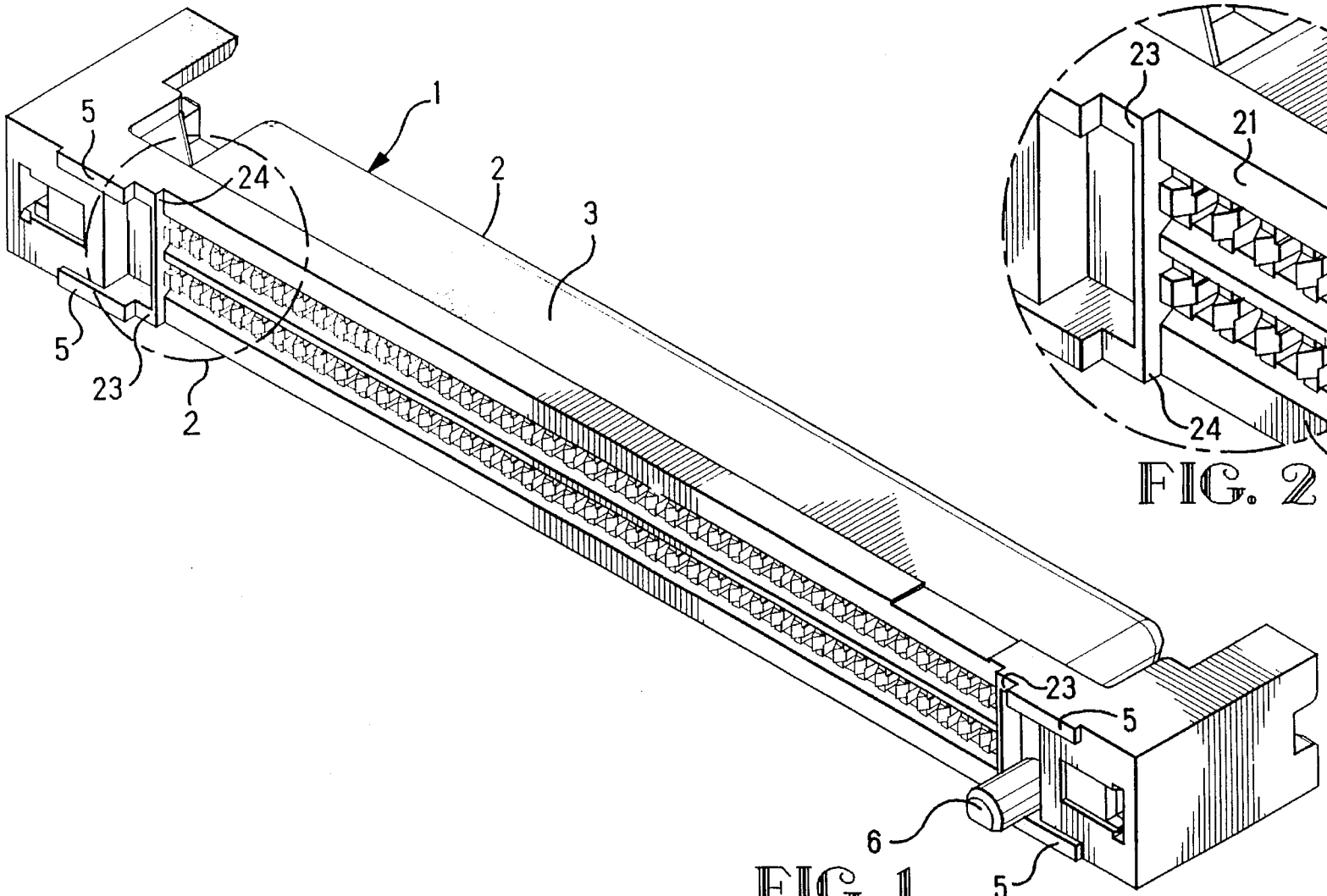
FIG. 1 is an isometric view of the housing of the connector of the present invention.
Figure 4:
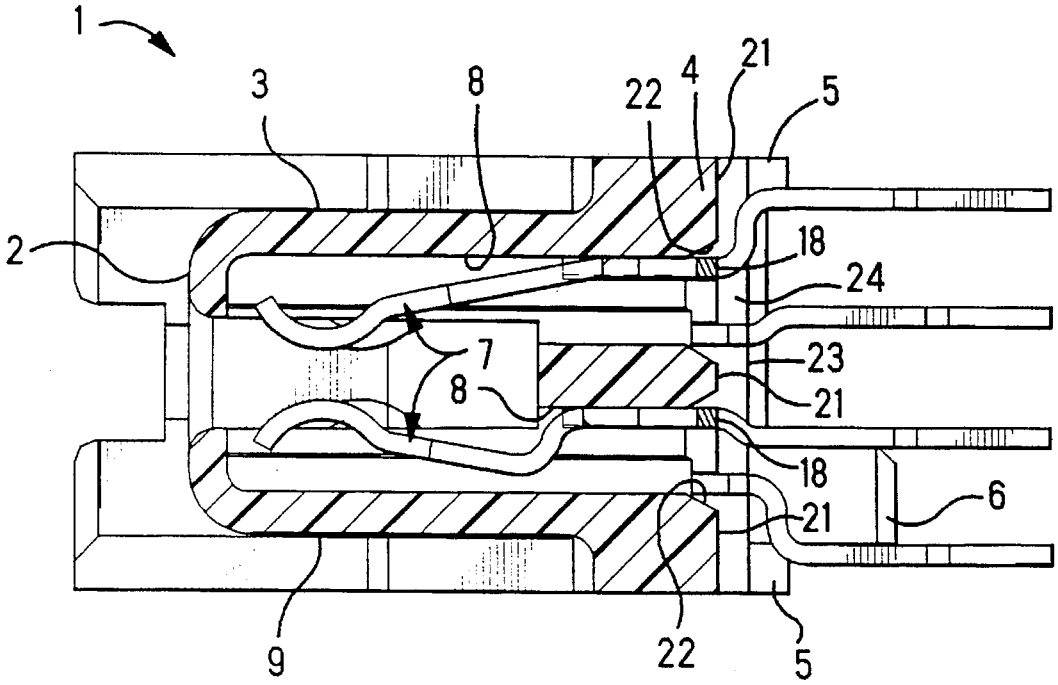

With reference to FIGS. 1, 2 and 4, a first marker surface 21 on the housing 3 is on a corresponding rear facing ledge 22 adjacent to a corresponding cavity 8. Each contact 7 in a corresponding cavity 8 is constructed for being inserted and moved along a cavity 8 until the marker surface 18 on the contact 7 is aligned with respect to the first marker surface 21 on the housing 3. FIG. 4 shows a contact 7 in the row 10 and another contact 7 in the row 11 with the marker surfaces 18, 21 aligned with respect to one another.

Figure 3:
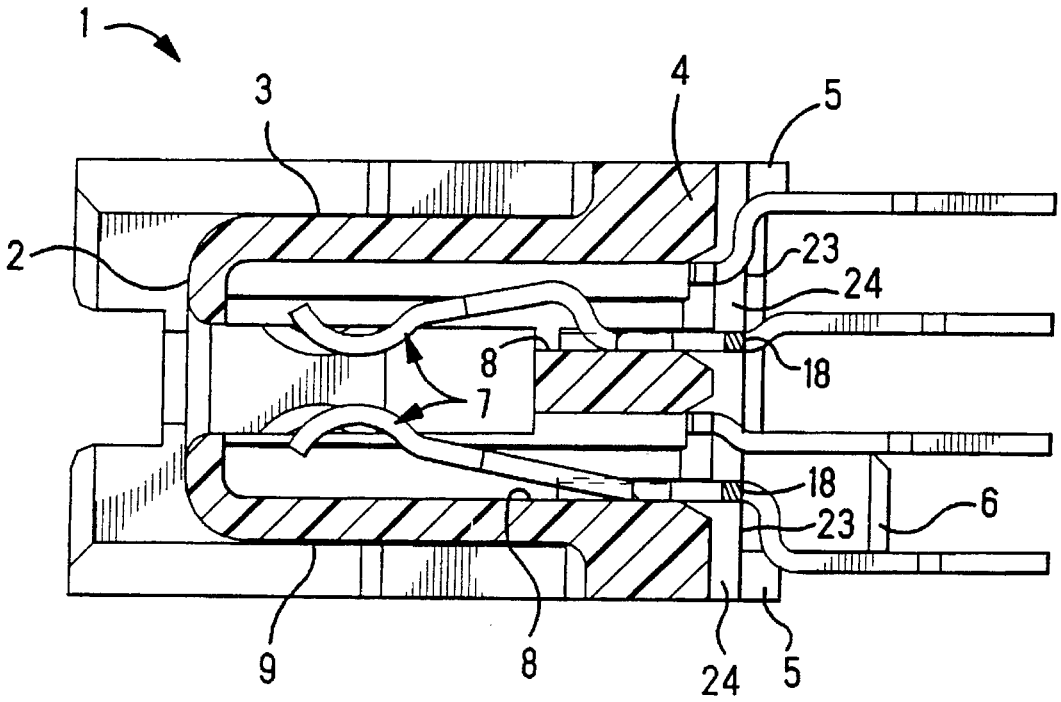
FIGS. 3 and 4 are enlarged section views of an electrical connector taken along first and second locations, with parts cut away and with parts in section.

With reference to FIGS. 1, 2 and 3, a second marker surface 23 on the housing 3 is on a corresponding rear facing second ledge 24 adjacent to a corresponding cavity 8. Each contact 7 in a corresponding cavity 8 is constructed for being inserted and moved along a cavity 8 until the marker surface 18 on the contact 7 is aligned with respect to the second marker surface 23 on the housing 3. FIG. 3 shows a contact 7 in the row 10 and another contact 7 in the row 11 with the marker surfaces 18, 23 aligned with respect to one another. The first marker surface 21 and the second marker surface 23 are positioned at different respective depths axially from rear to front.

To determine a depth of insertion of each contact 7 along a respective cavity, each contact 7 is inserted from rear to front along a corresponding cavity 8, until the marker surface 18 on the contact 7 is aligned with respect to one of the rear facing marker surfaces 21, 23 on the housing. Each contact 7 in a forward position in the housing 3 has its marker surface 18 aligned with respect to the first marker surface 21. Each contact 7 in a rearward or receded position has its marker surface 18 aligned with respect to the second marker surface 23.

For example, one embodiment of the connector 1 has the contacts 7 in contact position numbers 1, 36 through 40, 41 through 47, and 74 through 80 at forward positions in the cavities 8. The contacts 7 are inserted along the contact receiving cavities 8, numbered 1, 36, 41 and 76, by engaging a straight surface of an insertion tool, not shown, against the marker surfaces 18 on the contacts 7, and by impelling the contacts 7 along the cavities 8 until the marker surfaces 18 are aligned with respect to corresponding marker surfaces 21 on the housing. The straight surface of the insertion tool may bridge across space between the marker surfaces 18 and 21, and may overlap and impinge against the corresponding marker surfaces 21 to limit travel of the insertion tool, and to limit movement of the contacts 7 in the direction of insertion.

Additional contacts 7 are inserted in corresponding cavities 8 until the marker surfaces 18 on the additional contacts 7 are aligned with respect to corresponding marker surfaces 23. Thereby the additional contacts 7 are positioned rearward relative to the forward positioned contacts 7 in the contact positions 1, 36, 41 and 76. For example, a straight surface on an insertion tool, not shown, can be used to impinge the marker surfaces 18 on the additional contacts 18 and corresponding marker surfaces 23. The straight surface on the insertion tool may overlap and impinge against the corresponding marker surfaces 23 to limit travel of the insertion tool; and to limit movement of the additional contacts 7 in the direction of insertion. Further, for example, another embodiment of the connector 1 has solely the contacts 7 in contact positions 2, 3, 4 and 35 at rearward position.

Although the embodiments are described with the marker surface 18 in alignment that is straight coplanar with respect to the corresponding marker surfaces 21 and 23, the marker surfaces 18 may be positioned at any other desired alignment with respect to the corresponding marker surfaces 21 and 23, so as to provide at least one contact 7 in a rearward position and at least one contact 7 in a forward position in the housing 2.

An advantage of the invention resides in electrical contacts 7 of the same size in a row 10 or in a row 11, in the housing 3 being spaced at different distances along the housing 3, and being spaced at different distances from a mating end 2 of the connector 1.

Other advantages, embodiments and modifications of the invention are intended to be covered by the spirit and scope of the claims.

We claim:

1. An electrical connector comprising: multiple electrical contacts extending axially along respective contact receiving cavities in an insulating housing upon insertion of said contacts thereinto from an insertion face toward a mating end of the housing, wherein at least two transverse marker surfaces on the housing are positioned at different depths along an axis of the housing and exposed to said insertion face to be engageable by insertion tooling to limit travel thereof during contact insertion, and wherein each of said electrical contacts is provided with at least one respective tool-engageable transverse marker surface that is, upon contact insertion, in coplanar nonabutting relationship with respect to selected one of the housing marker surfaces depending upon the desired depth of insertion of the contact into the housing.

2. An electrical connector as recited in claim 1 wherein at least one of the contacts is in a forward position with said marker surface thereof in alignment with respect to a forward marker surface on the housing.

3. An electrical connector as recited in claim 1 wherein at least one of the contacts is in a rearward position with said marker surface thereof on said one of the contacts in alignment with respect to a rearward marker surface on the housing.

4. An electrical connector as recited in claim 1 wherein the contact receiving cavities are identical and thereby are adapted to receive the electrical contacts to different insertion depths interchangeably in respective cavities.

5. An electrical connector as recited in claim 1 wherein the marker surfaces on the housing are adjacent respective contact receiving cavities in the housing, and the contacts are received in respective cavities.

6. An electrical connector as recited in claim 1 wherein at least one of the contacts is spaced farther from a mating end of the housing than at least one other contact of identical shape and mass.

7. An electrical connector as recited in claim 1, wherein either one of the contact receiving cavities is adapted to receive identical contacts equally spaced from the mating end of the housing.

* * * * *